US007670115B2

(12) United States Patent
Cho et al.

(10) Patent No.: US 7,670,115 B2
(45) Date of Patent: Mar. 2, 2010

(54) TURBO FAN

(75) Inventors: Min Gi Cho, Suwon-si (KR); Weon Seok Choi, Seoul (KR); You Jae Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 599 days.

(21) Appl. No.: 11/599,285

(22) Filed: Nov. 15, 2006

(65) Prior Publication Data

US 2007/0237643 A1 Oct. 11, 2007

(30) Foreign Application Priority Data

Apr. 11, 2006 (KR) ..... 10-2006-0032901

(51) Int. Cl.
*F04D 29/30* (2006.01)

(52) U.S. Cl. ..... 416/186 R; 416/228; 416/243; 416/223 B

(58) Field of Classification Search ..... 416/185, 416/186 R, 234, 228, 223 B
See application file for complete search history.

(56) References Cited

U.S. PATENT DOCUMENTS 3,368,744 A * 2/1968 Jenn ..... 416/237
5,964,576 A 10/1999 Fujita et al.
6,224,335 B1 * 5/2001 Parisi et al. ..... 415/206
6,755,615 B2 * 6/2004 Chapman ..... 415/206
6,769,876 B2 * 8/2004 Sakai et al. ..... 416/187

FOREIGN PATENT DOCUMENTS

| | | |
|---|---|---|
| CN | 1500996 | 6/2004 |
| JP | 2001-263294 | 9/2001 |
| JP | 2005-320881 | 11/2005 |
| KR | 2002-19153 | 3/2002 |
| KR | 2002-19154 | 3/2002 |

OTHER PUBLICATIONS

Chinese Office Action dated May 16, 2008 issued in CN 2006-10162958.6.

CN Office Action issued Jun. 19, 2009 in Chinese Application No. 200610162958.6.

* cited by examiner

*Primary Examiner*—Ninh H Nguyen
(74) *Attorney, Agent, or Firm*—Stanzione & Kim LLP

(57) ABSTRACT

A turbo fan includes a plurality of blades positioned vertically in a radial direction between a main plate and a shroud. Each of the plurality of blades is formed with a slope at an outer periphery thereof to suppress generation of turbulence.

11 Claims, 6 Drawing Sheets

FIG. 6A

| Air volume(CMM) | RPM(rpm) | Power consumption(W) | Noise(dBA) |
|---|---|---|---|
| 32.59 | 635 | 184.0 | 46.5 |
| 30.14 | 592 | 163.0 | 44.5 |
| 27.55 | 546 | 143.0 | 42.3 |
| 25.05 | 502 | 123.0 | 39.9 |

FIG. 6B

| Air volume(CMM) | RPM(rpm) | Power consumption(W) | Noise(dBA) |
|---|---|---|---|
| 32.63 | 634 | 184.0 | 45.8 |
| 30.24 | 594 | 163.0 | 43.8 |
| 27.62 | 550 | 142.0 | 42.3 |
| 25.16 | 504 | 12.0 | 39.1 |

TURBO FAN

CROSS-REFERENCE TO RELATED APPLICATIONS

This application claims priority under 35 U.S.A. §119(a) from Korean Patent Application No. 2006-0032901, filed on Apr. 11, 2006 in the Korean Intellectual Property Office, the disclosure of which is incorporated herein in its entirety by reference.

BACKGROUND OF THE INVENTION

1. Field of the Invention

The present general inventive concept relates to a turbo fan for an air conditioner, and more particularly, to a turbo fan which comprises blades adapted to reduce noise.

2. Description of the Related Art

Generally, a blowing fan is used as a means of transferring air by virtue of a rotational force of a rotor or blades, and is mounted in a refrigerator, an air conditioner, a vacuum cleaner, etc.

In particular, the blowing fan is classified into an axial flow fan, a sirocco fan, a turbo fan, etc. according to a manner of suctioning or discharging air or the shape of the blowing fan. The turbo fan is a blowing fan which sucks air in an axial direction of the turbo fan, and discharges the air radially through spaces between blades, that is, through a lateral side of the turbo fan.

The turbo fan does not require a duct, and can be applied to a relatively large product, since it is adapted to allow air to be naturally induced into the fan and then discharged from the fan to the outside of the fan.

FIG. 1 is a cross-sectional view illustrating an air conditioner having a conventional turbo fan, FIG. 2 is a perspective view illustrating a structure of the conventional turbo fan, and FIG. 3 is a perspective view illustrating a structure of a conventional turbo fan different from that illustrated in FIG. 2.

Referring to FIG. 1, an air conditioner includes a cabinet 1 defining an appearance of the air conditioner and being embedded in a ceiling, a turbo fan 10 positioned within the cabinet 1, a fan motor 2 connected to the turbo fan 10, and a heat exchanger 3 around a discharge part of the turbo fan 10.

The cabinet 1 includes a suction port 1*a* to suck air in a room, and a discharge port 1*b* to discharge conditioned air into the room.

Referring to FIG. 2, the turbo fan 10 of FIG. 1 includes a main plate 11 having a hub 11*a* coupled to a rotational shaft of the fan motor 2 of FIG. 1, a plurality of blades 12 arranged radially at predetermined intervals on an outer periphery of the main plate 11 while being coupled perpendicularly to the main plate 11, and a shroud 13 coupled in a ring shape to the blades 12 along one end of each blade 12.

The turbo fan 10 is formed at a front side thereof with a suction port 14, and at a lateral side thereof with discharge ports 15 such that, when the turbo fan 10 is rotated by a driving force of the fan motor 2, external air is sucked into the turbo fan 10 through the suction port 14 defined inside the shroud 13 via a suctioning force, and then flows towards the discharge ports 15 along pathways between the blades 12.

Such a conventional turbo fan 10 is assembled through a post-machining process, such as thermal bonding, after previously forming the main plate 11 and the plurality of blades 12 with a single mold, and forming the shroud 13 with a different mold.

When the turbo fan 10 is made through such a post-machining process, outer ends 12*a* of the respective blades 12 are coupled to the main plate 11, thereby providing an advantageous effect in air flow. However, such a method for producing the conventional turbo fan increases the number of assembling operations, the number of molds, and production times.

In order to solve the problems as described above, a turbo fan 20 illustrated in FIG. 3 is formed by integrally molding a main plate 21, blades 22, and a shroud 23 with a single mold.

In order to adopt such a molding method, an outer diameter of the main plate 21 is smaller than or equal to an inner diameter of the shroud 23 such that the turbo fan 20 can be easily taken out of the mold. When the turbo fan 20 is made according to this method, the number of assembling operations and the number of molds are decreased, thereby lowering manufacturing costs. However, with this method, since outer low ends 22*a* of respective blades 22 are exposed to the outside of the turbo fan, the turbo fan is more likely to generate turbulence at a predetermined portion of the blades 22 upon rotation of the turbo fan 20 in comparison to the conventional turbo fan 10 illustrated in FIG. 2. Specifically, turbulence may be generated at the outer low end 22*a* of each blade 22.

Such turbulence deteriorates air flow through the pathways, causing noise.

SUMMARY OF THE INVENTION

The present general inventive concept provides a turbo fan which includes blades adapted to reduce noise.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept are achieved by providing a turbo fan including a plurality of blades positioned vertically in a radial direction from a center point and between a main plate and a shroud, wherein each of the blades is formed with a slope at an outer periphery thereof to suppress generation of turbulence.

The slope may be formed at a lower end of each blade.

The slope may be formed downwardly with respect to a rotational direction of the blade.

The slope may be formed in a streamline shape or in a straight line shape.

The main plate may have an outer diameter less than or equal to an inner diameter of the shroud.

The main plate, the shroud, and the blade may be integrally formed through inject molding.

The foregoing and/or other aspects and utilities of the present general inventive concept may also be achieved by providing a turbo fan including a plurality of blades positioned vertically in a radial direction from a point and between a main plate and a shroud, wherein the blades are formed to have a constant thickness, and are formed with a slope at an outer periphery thereof to suppress generation of turbulence.

Each of the blades may have an extension extending a predetermined length toward a discharge side with respect to the main plate, and the slope may be formed at a lower surface of the extension.

The foregoing and/or other aspects and utilities of the present general inventive concept may also be achieved by providing a turbo fan, including a main plate having a circular shape, a plurality of blades connected to the main plate at a first side thereof, the blades extending radially outward along the main plate at predetermined intervals and having a sloped portion on an outer part of the first side thereof, and a shroud connected to an inner part of a second side of the plurality of blades such that the shroud is parallel to the main plate.

The plurality of blades each may curve as they extend radially away from the center of the main plate.

The plurality of blades may be separated from each other at equal intervals.

The shroud may be formed in a ring shape.

The sloped portion may extend along the first side of the blade.

The foregoing and/or other aspects and utilities of the present general inventive concept may also be achieved by providing a turbo fan, including a plurality of blades, a main plate coupled to a first side of each blade at a first portion of each of the plurality of blades such that the plurality of blades are arranged radially from a center point of the main plate at predetermined intervals, and a shroud coupled to each of the plurality of blades at a second side of each blade opposite to the first side of each blade coupled to the main plate.

The shroud may define a suction port in the center thereof to guide an intake of air.

A second portion of the first side of each of the plurality of blades may extend away from the main plate and may include a slope.

The slope may be formed on the second portion of the first side not coupled to the main plate.

The slope may be disposed at the first side in a position such that an edge is not formed at the periphery of the first side of each blade.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 6A is a table illustrating experimental performance of the conventional turbo fan illustrated in FIG. 3, and FIG. 6B is a table illustrating experimental performance of the turbo fan according to an embodiment of the present general inventive concept.

DETAILED DESCRIPTION OF THE PREFERRED EMBODIMENTS

Figure 1:
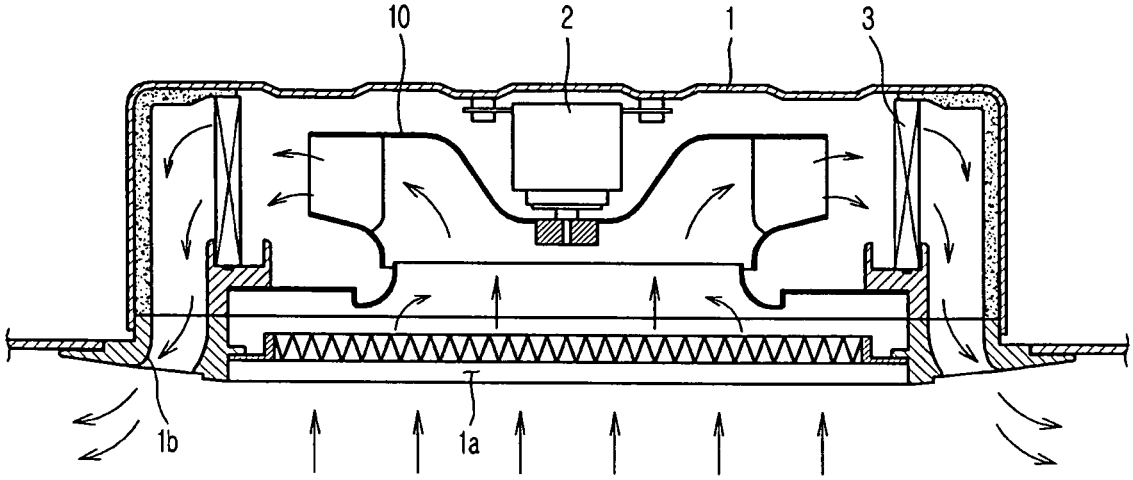
FIG. 1 (PRIOR ART)
FIG. 1 is a cross-sectional view of an air conditioner having a conventional turbo fan.
Figure 2:
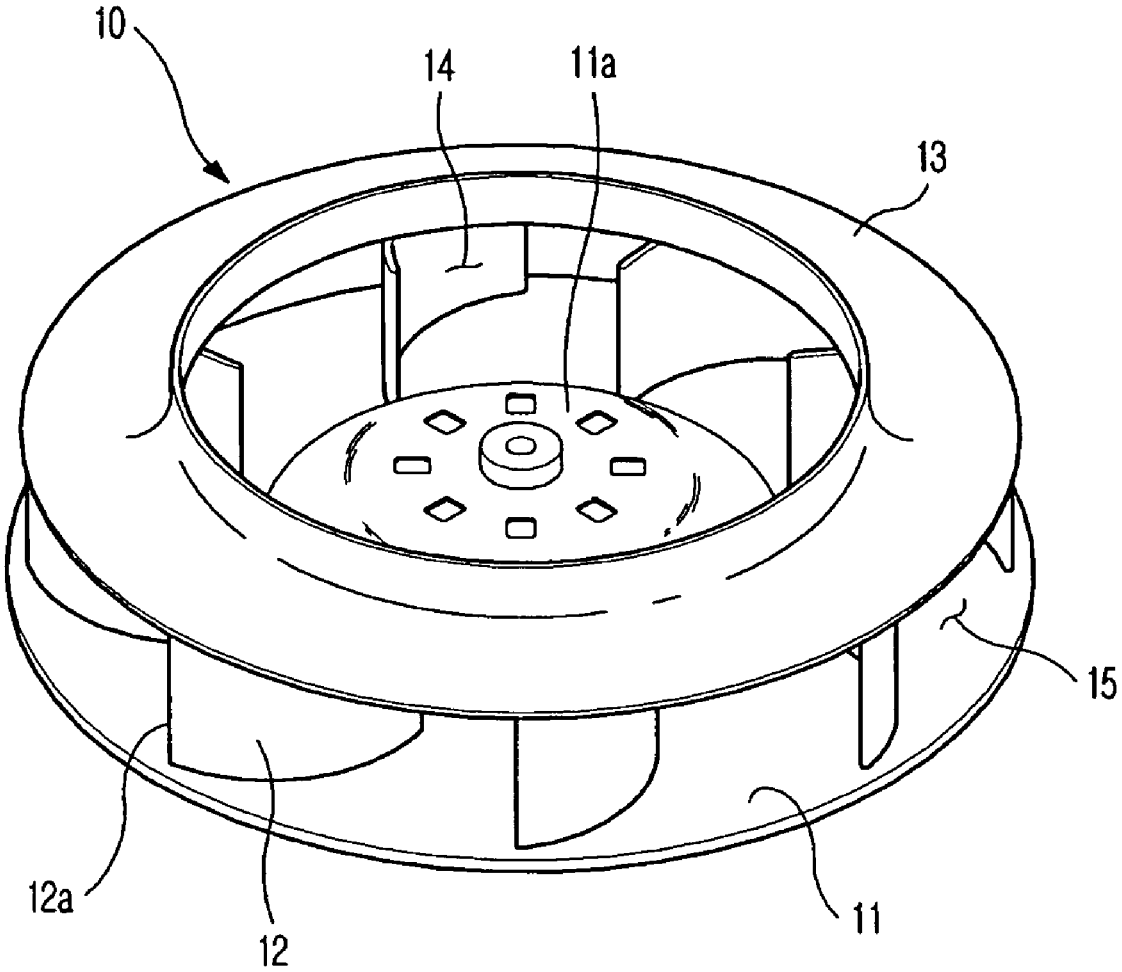
FIG. 2 (PRIOR ART)
FIG. 2 is a perspective view illustrating a structure of the conventional turbo fan of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 4:
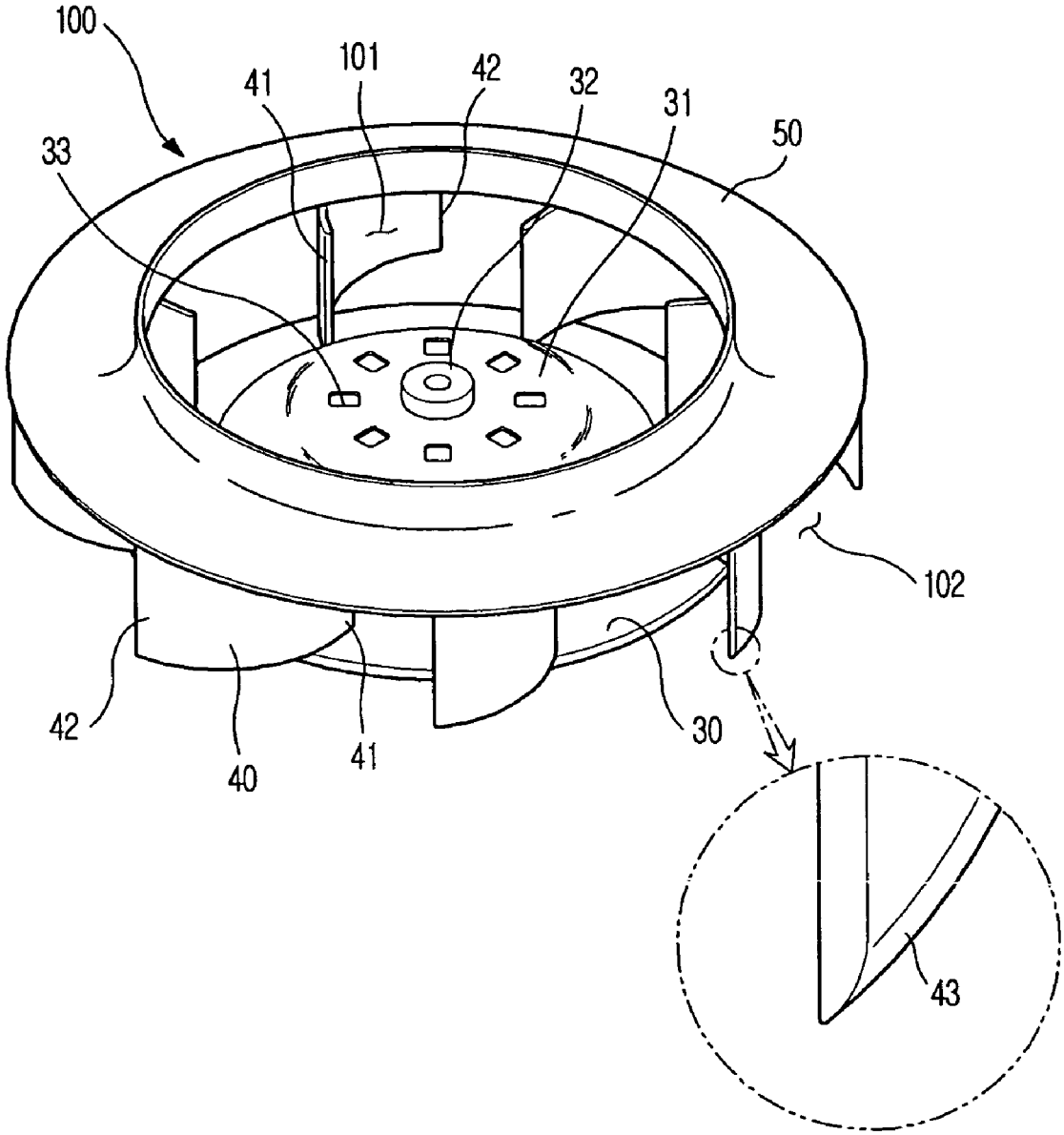
FIG. 4 illustrates a perspective view of a turbo fan according to an embodiment of the present general inventive concept.
Figure 5A:
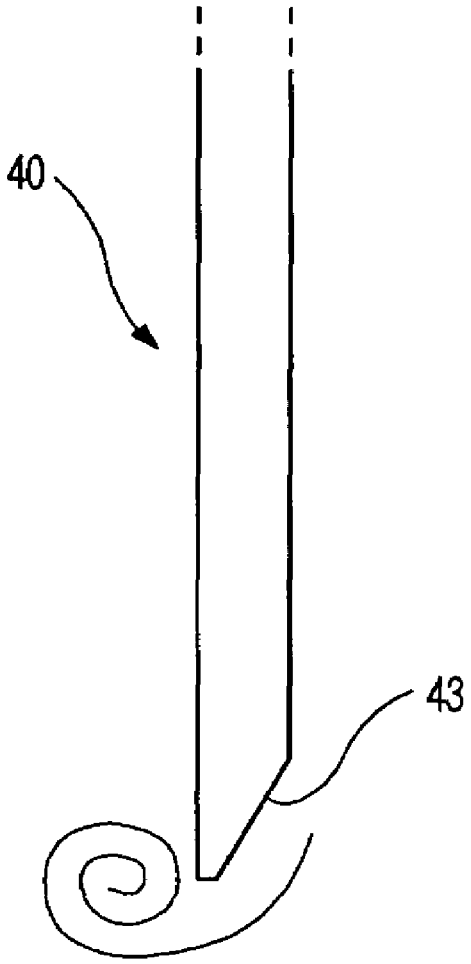
FIGS. 5A and 5B are partially cross-sectional views illustrating a blade included in the turbo fan of FIG. 4.
Figure 5B:
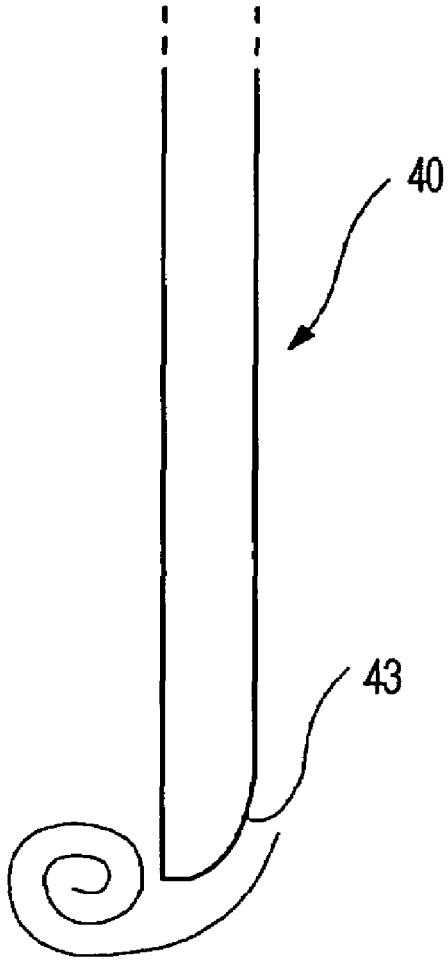

FIG. 4 illustrates a perspective view of a turbo fan according to an embodiment of the present general inventive concept, and FIGS. 5A and 5B are partially cross-sectional views illustrating a blade included in the turbo fan of FIG. 4.

Referring to FIG. 4, a turbo fan 100 according to an embodiment of the present general inventive concept may include a main plate 30 having a hub 31 positioned at the center thereof and coupled to a rotational shaft of a fan motor (not illustrated), a plurality of blades 40 arranged radially at predetermined intervals on an outer periphery of the main plate 30 while being coupled perpendicularly to the main plate 30, and a shroud 50 coupled in a ring shape to upper surfaces of the respective blades 40 to prevent vibration and to guide air flow.

The main plate 30 may have a disc shape having a predetermined thickness, and may include the hub 31 positioned at the center thereof to connect with the fan motor (not illustrated), and a connection boss 32 formed at the center of the hub 31 to allow insertion of the rotational shaft of the fan motor (not illustrated) therein.

The hub 31 may protrude in a front direction from the main plate 30 to define a space at a rear side of the hub 31 such that the rotational shaft of the fan motor (not illustrated) can be inserted into the space, and the hub 31 may have holes 33 formed in a circumferential pattern outside the connection boss 32 to prevent overheating of the fan motor (not illustrated).

The blades 40 are disposed such that, when receiving a rotational force from the fan motor (not illustrated), the blades 40 rotate along with the rotational shaft of the fan motor (not illustrated) to generate a centrifugal force or a centripetal force to suck air axially with respect to the turbo fan 100 and to discharge air radially with respect to the turbo fan 100. To this end, the plurality of blades 40 are vertically installed to the main plate 30, and arranged at predetermined intervals on an outer periphery of the main plate 30 to define a curved pathway between the blades 40.

The plurality of blades 40 may be formed to have a constant thickness in order to reduce shrinkages or molding imperfections which can occur upon injection molding of streamline-shaped blades. In addition, a portion of each blade 40 may be located on the main plate 30, and a remaining portion of each blade 40 may extend away from the main plate 30. In other words, each blade 40 may have an inlet side 41 located on the main plate 30, and an outlet side provided as an extension 42 extending away from the main plate 30.

The shroud 50 is positioned in a ring shape on first ends of the blades 40 while connecting the respective blades 40. The shroud 50 is rounded in the axial direction such that a diameter of the shroud 50 gradually decreases towards a front side thereof extending away from the main plate 30.

The shroud 50 defines at a center thereof a suction port 101 through which air is sucked. In addition, discharge ports 102 are formed at a side of the turbo fan 100, that is, at an outside of pathways defined between the blades 40 and between the shroud 50 and the main plate 30. Accordingly, when the turbo fan 100 is rotated by a driving force of the fan motor (not illustrated), air is sucked into the turbo fan 100 through the suction port 101 defined inside the shroud 50 by the rotational force of the turbo fan 100, and is discharged towards the discharge ports 102 through the pathways between the blades 40.

In the turbo fan according to an embodiment of the present general inventive concept, each blade 40 may be formed with a slope 43 at an outer periphery thereof to suppress a generation of turbulence.

In other words, as the blades 40 are rotated, turbulence is generated along the end of the extension 42 of each blade 40, causing a noise of the turbo fan 100. Thus, in order to reduce the noise by reducing the generation of turbulence, the slope 43 can be formed at the end of the extension 42 of each blade 40.

While FIG. 4 illustrates the slope 43 as being formed at the lower end of the extension 42 of each blade 40, the present general inventive concept is not limited thereto, and the slope 43 may be formed at a lateral end along with the lower end of the extension 42 of each blade 40. The slope 43 may also be formed downwardly with respect to a rotational direction of the blades 40. In addition, the slope 43 may be formed with various slope surfaces including, for example, a straight line shape and a streamline shape as illustrated in FIGS. 5A and 5B. Additionally, the slope 43 may be formed at an angle of 45~60 degrees downwardly with respect to the rotational direction of the blades 40, and the slope 43 at the extension 42 may be disposed such that an edge is not formed on the extension 42 of each blade 40.

Figure 3:
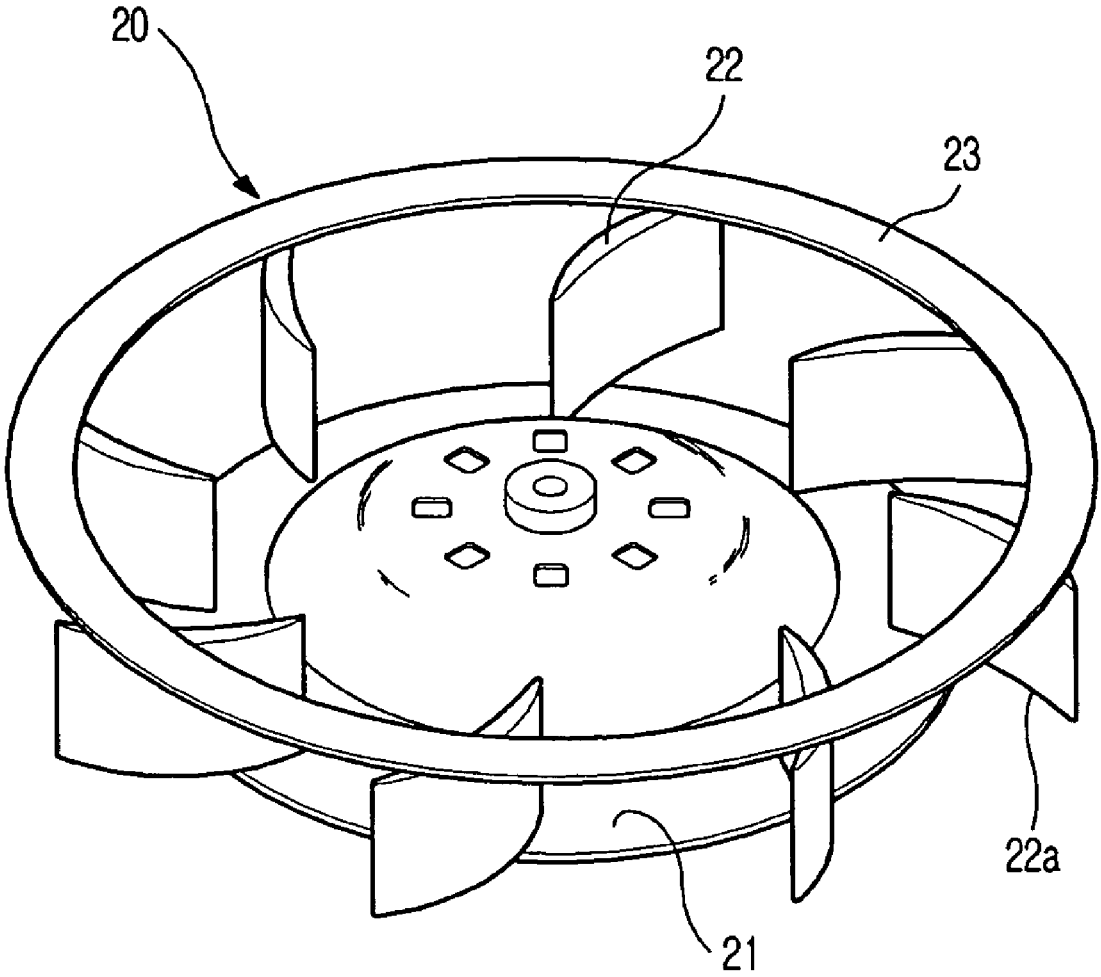
FIG. 3 (PRIOR ART)
FIG. 3 is a perspective view illustrating a structure of a conventional turbo fan different from that illustrated in FIG. 2.

FIG. 6A is a table illustrating experimental performance of the conventional turbo fan illustrated in FIG. 3, and FIG. 6B is a table illustrating experimental performance of a turbo fan according to an embodiment of the present general inventive concept.

As illustrated in FIGS. 6A and 6B, according to results of experiments performed using the conventional turbo fan and the turbo fan according to an embodiment of the present general inventive concept in various conditions of an air volume, noise is reduced by about 0.7~0.8 dBA in the turbo fan according to the present general inventive concept under a condition in which the air volume for both turbo fans is maintained at substantially the same level.

These results also illustrate that the turbo fan according to an embodiment of the present general inventive concept can generate a greater air volume than the conventional turbo fan under the same noise condition.

A turbo fan according to an embodiment of the present general inventive concept can be applied to a variety of applications, such as the air conditioner illustrated in FIG. 1.

In addition, according to an embodiment of the present general inventive concept, a main plate of a turbo fan may have an outer diameter less than or equal to an inner diameter of a shroud so that, when forming the turbo fan using a single mold, the turbo fan can be easily taken out from the mold. Accordingly, a turbo fan according to an embodiment of the present general inventive concept integrally comprising a main plate, a plurality of blades and a shroud can be produced without performing a post-machining process in which, after integrally molding the main plate and the plurality of blades, the shroud is separately molded and attached to the blades.

A turbo fan according to an embodiment of the present general inventive concept can also be integrally formed by injection molding, and reduce noise by a simple modification of an outer appearance to have a slope formed at each of the blades.

A turbo fan according to an embodiment of the present general inventive concept may have slopes formed at the outer periphery of a plurality of blades at an outlet side thereof to suppress a generation of turbulence, thereby reducing noise.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A turbo fan, comprising:

a plurality of blades;

a main plate coupled to a driving motor and integrally connected to a first side of each blade at a first portion of each of the plurality of blades such that the plurality of blades are arranged radially with respect to a center point of the main plate at predetermined intervals; and a shroud having an opening with a diameter greater than or equal to an outer diameter of the main plate;

wherein the shroud, the main plate and the blades are integrally formed by injection molding such that the shroud is connected to each of the plurality of blades at a second side of each blade opposite to the first side of each blade; and a second portion of the first side of each blade that is not connected to the main plate is formed with a slope decreasing in thickness at an outer periphery thereof.

2. The turbo fan of claim 1, wherein the opening of the shroud defines a suction port disposed at a center thereof to guide an intake of air.

3. The turbo fan of claim 1, wherein a region of each blade with the slope decreases in thickness in a rotational direction of the blade.

4. The turbo fan of claim 1 wherein the slope is disposed at the first side in a position such that an edge is not formed at the periphery of the first side of each blade.

5. The turbo fan of claim 1, wherein the slope is formed in a streamline shape.

6. The turbo fan of claim 1, wherein the slope is formed in a straight line shape.

7. The turbo fan of claim 1, wherein each blade has a substantially constant thickness except for a region thereof having the slope.

8. The turbo fan of claim 1, wherein each of the plurality of blades is curved as each blade extends radially away from a center of the main plate.

9. An air conditioner comprising:

a case;

a turbo fan provided within the case;

a fan motor to drive the turbo fan; and a heat exchanger provided around a discharge part of the turbo fan, the turbo fan comprising:

a plurality of blades, a main plate coupled to the fan motor and connected to a first side of each blade at a first portion of each of the plurality of blades such that the plurality of blades are arranged radially with respect to a center point of the main plate at predetermined intervals, and a shroud connected to each of the plurality of blades at a second side of each blade opposite to the first side of each blade, wherein a second portion of the first side of each blade that is not connected to the main plate is formed with a slope decreasing in thickness at an outer periphery thereof.

10. The air conditioner of claim 9, wherein the shroud has an opening with a diameter greater than or equal to an outer diameter of the main plate so as to enable the blades, the main plate and the shroud to be integrally formed by injection molding.

11. The air conditioner of claim 9, wherein a region of each blade with the slope decreases in thickness in a rotational direction of the blade.

* * * * *